United States Patent [19]

Rawson

[11] 4,229,888

[45] Oct. 28, 1980

[54] FASTENER SUITABLE FOR ATTACHING A HEEL TO A SHOE

[75] Inventor: Francis F. H. Rawson, Loughborough, England

[73] Assignee: USM Corporation, Farmington, Conn.

[21] Appl. No.: 18,501

[22] Filed: Mar. 8, 1979

[30] Foreign Application Priority Data

Jul. 28, 1978 [GB] United Kingdom ..... 31530/78

[51] Int. Cl.[2] ..... A43B 21/36; A43B 23/20

[52] U.S. Cl. ..... 36/1; 36/23; 36/82; 85/13; 85/49

[58] Field of Search ..... 36/1, 82, 23, 24.5, 36/34 A; 85/13, 49; 12/142 J

[56] References Cited

U.S. PATENT DOCUMENTS

| | | | |
|---|---|---|---|
| 1,647,525 | 11/1927 | Kelly et al. | 36/24.5 X |
| 2,151,978 | 3/1939 | Lancaster | 36/24.5 X |
| 2,261,734 | 11/1941 | Ricks et al. | 85/49 X |
| 4,128,609 | 12/1978 | Rawson . | |

FOREIGN PATENT DOCUMENTS

| | | | |
|---|---|---|---|
| 645255 | 7/1962 | Canada . | |
| 30161 | 1/1885 | Fed. Rep. of Germany | 85/49 |
| 613193 | 5/1935 | Fed. Rep. of Germany | 36/34 A |
| 617004 | 8/1935 | Fed. Rep. of Germany | 36/34 A |
| 193405 | 12/1937 | Switzerland | 85/13 |
| 797766 | 7/1958 | United Kingdom | 85/49 |

*Primary Examiner*—James Kee Chi

*Attorney, Agent, or Firm*—Owen J. Meegan; Richard B. Megley; Vincent A. White

[57] ABSTRACT

The invention concerns a fastener suitable for use in attaching a plastic heel to a shoe. The fastener comprises a generally flat head portion and at least three shank portions extending from the head portion. Each shank portion has at least one aperture therein into which melted or softened plastic material of the heel can flow and upon solidification, lock the fastener to the heel.

15 Claims, 4 Drawing Figures

FASTENER SUITABLE FOR ATTACHING A HEEL TO A SHOE

BACKGROUND OF THE INVENTION

This invention is concerned with a fastener suitable for attaching a heel to a shoe and is particularly concerned with a fastener suitable for use in attaching a plastic heel to a shoe by a method in which plastic material of the heel is melted or softened to allow the fastener to enter the heel.

In the shoe industry, heels, whether made of plastic material or of wood, are attached by driving fasteners such as nails or staples into the heels through insoles of the shoes to which the heels are attached. In the case of plastic heels, the holding power of a fastener driven into the heel may not be sufficient because the fastener on entry shatters the surrounding plastic material. This is especially the case where the length of the fastener is restricted by the shape of the heel.

We have developed an improved fastener for attaching a plastic heel to a shoe. The fastener is inserted into the plastic material of the heel by melting or softening the material to allow it to enter. In particular the fastener of the invention provides increased holding power and ease of insertion over ordinary fasteners such as nails or staples.

SUMMARY OF THE INVENTION

There are hereinafter described in detail three fasteners which are illustrative of the invention. The three illustrative fasteners each comprise a generally flat head portion made from spring steel and intended in the finished shoe to overlie the insole of the shoe. The three illustrative fasteners also each comprise at least three shank portions, the first and third illustrative fasteners having four shank portions and the second having three. These shank portions are also made from spring steel and extend from the head portion parallel to one another and generally normally to the head portion. Each shank portion has at least one aperture therein in the form of a circular hole. These apertures allow melted or softened plastic material of the heel to flow into them when the fastener is inserted into a plastic heel so that, upon solidification of the plastic material in the aperture, the fastener is locked to the heel.

Since heels, especially those of ladies' shoes, often taper sharply at the rear thereof, the rearward shank portion or shank portions of each of the three illustrative fasteners are shorter than two forward shank portions thereof so that allowance is made for this taper.

The invention provides a fastener suitable for use in attaching a plastic heel to a shoe by a method such as described in U.S. Pat. No. 4,128,609, in which plastic material of the heel is melted or softened to allow the fastener to enter the heel. The fastener comprises a generally flat head portion and at least three shank portions extending from the head portion parallel to one another and generally normally to the head portion, each shank portion having at least one aperture therein into which, when the fastener is inserted into a plastic heel, melted or softened plastic material of the heel can flow so that, upon solidification of the plastic material, the fastener is locked to the heel.

There now follows a detailed description, to be read with reference to the accompanying drawings, of the three illustrative fasteners aforementioned. These fasteners have been selected for description to illustrate the invention by way of example.

DESCRIPTION OF THE PREFERRED EMBODIMENT

Each of the three illustrative fasteners shown in the accompanying drawings is made of spring steel and is suitable for use in attaching a plastic heel to a shoe by a method in which plastic material of the heel is melted or softened to allow the fastener to enter.

Figure 1:
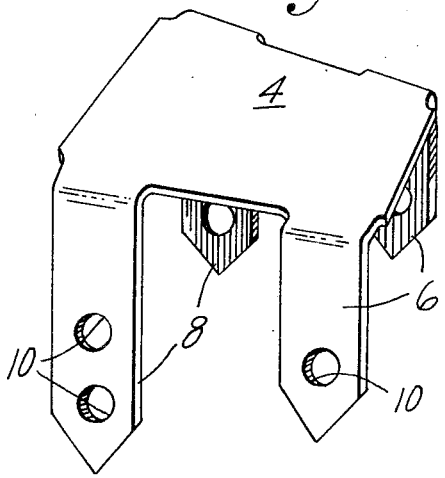
FIG. 1 is a perspective view of the first illustrative fastener.

The first illustrative fastener (FIG. 1) comprises a generally flat head portion 4 and four shank portions, viz. two rearward shank portions 6 and two forward shank portions 8. The shank portions 6 and 8 are integral with the head portion 4 having been formed from a single piece of spring steel by bending the shank portions 6 and 8 out of the plane of the head portion 4. The shank portions 6 and 8 extend from the head portion 4 parallel to one another and generally normal to the head portion 4. Each shank portion 6 and 8 has a pointed end to aid in insertion and has at least one aperture therein in the form of a circular hole 10, the shank portions 6 having one hole 10 each and the shank portions 8 having two holes 10 each.

The rearward shank portions 6 are opposed to one another on opposite sides of the fastener as are the forward shank portions 8. The forward shank portions 8 are arranged to enter opposite side portions of a forward portion of a heel when the rearward shank portions 6 enter opposite side portions of a rearward portion of the heel. The two rearward shank portions 6 are of equal length and shorter than the two forward shank portions 8 which are also of equal length. The shank portions 6 are shorter than the shank portions 8 to allow for tapering of the rearward portion of the heel so that the shank portions 6 will not project through the surface of the heel.

The head portion 4 is generally wedge-shaped when viewed from the side on which the shank portions 6 and 8 extend, the distance between the shank portions 6 being less than the distance between the shank portions 8. The shape of the head portion 4 allows the first illustrative fastener to be "nested" with other similar fasteners in an inserting machine with the head portion 4 of one fastener partially above the next fastener and the shank portions 8 straddling the next fastener.

Figure 2:
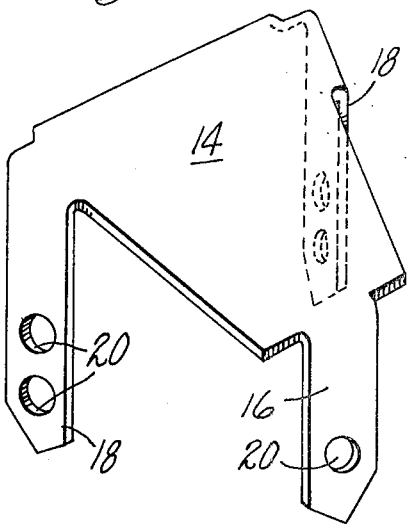
FIG. 2 is a perspective view of the second illustrative fastener.

The second illustrative fastener (FIG. 2) is similar to the first illustrative fastener in that it comprises a head portion 14 similar to the head portion 4 and two forward shank portions 18 similar to the shank portions 8 and each shank portion 18 has two circular holes 20 therein. However, instead of the shank portions 6, the second illustrative fastener has a single central shank portion 16 which has one circular hole 20 therein. The second illustrative fastener is formed from a single piece of spring steel. Thus, the second illustrative fastener has three shank portions, a rearward shank portion 16 and two opposed forward shank portions 18 arranged to enter opposite side portions of a forward portion of a heel when the rearward shank portion 16 enters a rearward portion of the heel. The rearward shank portion 16 is shorter than the two forward shank portions 18 which are of equal length.

Figure 3:
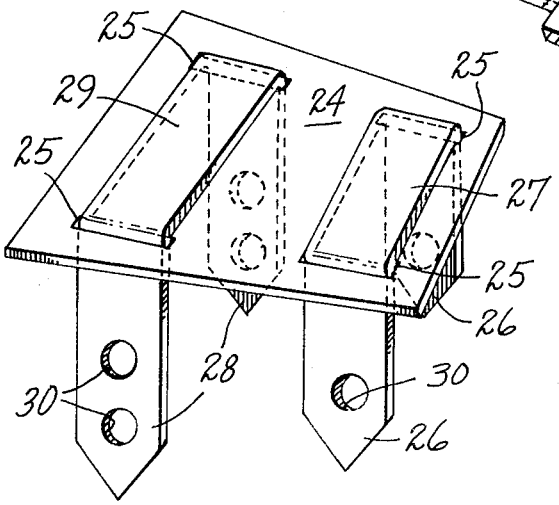
FIG. 3 is a perspective view of the third illustrative fastener.

The third illustrative fastener (FIG. 3) comprises a generally flat wedge-shaped head portion 24 defining four slots 25, two at a forward end portion of the head portion 24 and two at a rearward end portion thereof, the slots 25 at the rearward end portion being closer together than the other two slots 25. The third illustrative fastener also comprises two rearward shank portions 26 formed by the legs of a staple 27, the legs of which fit through the two slots 25 at the rearward portion of the head portion 24 to form the shank portions 26 and the head of which overlies the head portion 24. A further staple 29 has legs which fit through the two remaining slots 25 to form forward shank portions 28 of the third illustrative fastener. The shank portions 28 each have two holes 30 therein and the shank portions 26 each have one hole 30 therein. The shank portions 26 are shorter than the shank portions 28. The staples 27 and 29 are welded to the head portion 24 to form an integral fastener.

When any of the three illustrative fasteners is used to attach a plastic heel to a shoe, the shank portions 6, 8, 16, 18, 26 and 28 are inserted into slots in the insole of the shoe so that they engage the heel through the insole. The material of the heel adjacent the fastener is melted or softened by the application of heat thereto so that the shank portions of the fastener enter the heel. As the shank portions enter the heel, melted or softened plastic material of the heel flows into the aperture or apertures 10, 20 and 30 in the shank portions so that, upon solidification of the plastic material, the fastener is locked to the heel by the material in the aperture or apertures.

Figure 4:
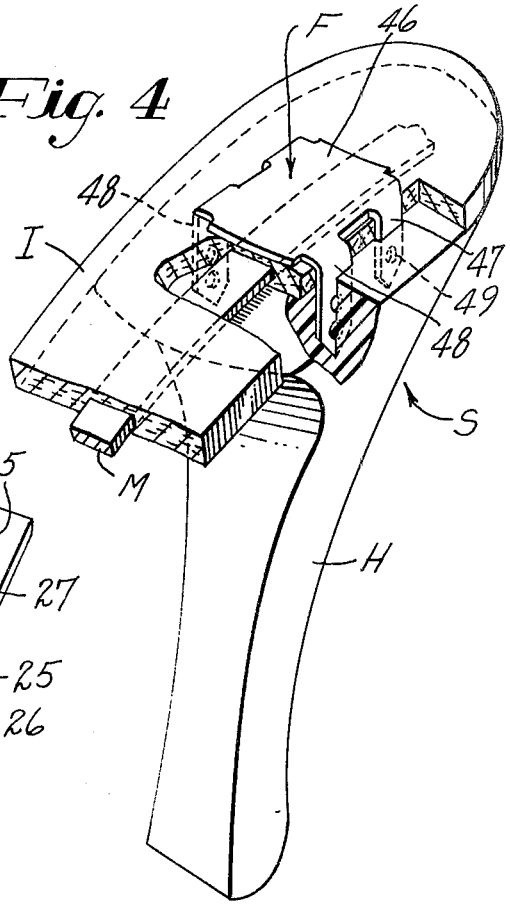
FIG. 4 is a perspective view of the heel portion of a shoe, partially broken away, showing one of the fasteners disposed between the insole and the heel.

FIG. 4 shows a portion of a shoe S, the shoe upper having been omitted for sake of clarity, after it has had a heel H attached thereto. The shoe S comprises an insole I and a metal shank M. The heel H is of the sharply tapered type although the illustrative fastener may be used with heels which are not of this type provided they are formed of thermoplastic material. The heel H may, for example, be made of polyethylene or polystyrene and may, if desired, incorporate metal stiffeners. As long as the central portion of the shoe engaging portion of the heel is made of thermoplastic material, the illustrative fastener can be used to attach the heel.

As explained previously with reference to FIG. 1, the fastener comprises a generally flat head portion 46 and four shank portions. The shank portions include two rearward elements 47 (only one shown in this figure) and two forward elements 48 and have been formed as explained previously. Each of these members has a point at the end to aid in insertion and at least one aperture 49 which allows for a passageway for heated plastic material from opposite sides of the shank to join together although the embodiment of FIG. 1 has been shown in FIG. 4, the embodiment of FIGS. 2 and 3 can be used interchangeably. The heel H is attached to the insole I by a positive interlock caused by the material of the heel which has flowed into the holes in the shanks. Through the use of three (or four) shanks, the attachment is sufficiently close to the edges of the heel to prevent gaps appearing between the heel and the insole while the shoe is in use but the total amount of insole material that is displaced for insertion of the shanks is sufficiently small to prevent the insole I from being significantly weakened. The legs are fairly easy to insert because of their small width and the points enter the heel H and fits through the insole fairly easily. A separate step of sharpening the ends of the legs is not necessary when using points because the fasteners can be stamped into a pointed configuration relatively easily in one operation.

It is apparent that modifications and changes can be made within the spirit and scope of the present invention, but it is my intention only to be limited by the following claims.

As my invention I claim:

1. A fastener suitable for use in attaching a plastic heel to a shoe, comprising:

a generally flat head portion and at least three shank portions extending from the head portion parallel to one another and generally normal to the head portion, each shank portion having at least one aperture therein.

2. A fastener according to claim 1 having three shank portions, a rearward shank portion and two opposed forward shank portions arranged to enter opposite side portions of a forward portion of a heel when the rearward shank portion enters a rearward portion of the heel.

3. A fastener according to claim 2 wherein the rearward shank portion is shorter than the two forward shank portions which are of equal length.

4. A fastener according to claim 1 having four shank portions, two opposed rearward shank portions and two opposed forward shank portions arranged to enter opposite side portions of a forward portion of a heel when the rearward shank portions enter opposite side portions of a rearward portion of the heel.

5. A fastener according to claim 4 wherein the two rearward shank portions are of equal length and shorter than the two forward shank portions which are of equal length.

6. A fastener according to claim 1 wherein the fastener is made of spring steel, the shank portions being integral with the head portion.

7. A fastener according to claim 6 wherein the shank portions and the head portion are formed from a single piece of spring steel, the shank portions being bent out of the plane of the head portion.

8. A fastener according to claim 1 wherein the shank portions are welded to the head portion.

9. A fastener according to claim 4 wherein the head portion defines four slots and the shank portions are formed by two staples, the legs of which fit through the slots to form the shank portions and the heads of which overlie the head portion.

10. A fastener according to claim 1 wherein the head portion is generally wedge-shaped when viewed from the side on which the shank portions extend.

11. In combination with a shoe having an insole and a plastic heel disposed adjacent said insole, and a fastener disposed between said heel and said insole, the improvement which comprises:

said fastener being formed of a generally flat head portion and at least three shank portions extending from the head portion parallel to one another and generally normal to the head portion, each shank portion having at least one aperture therein, the plastic from said heel being disposed within said aperture whereby the fastener is locked to the heel.

12. The shoe according to claim 11 wherein there are three shank portions, the rearward shank portion and two opposed forward shank portions arranged to enter opposite side portions of the forward portion of the heel when the rearward shank portion enters a rearward portion of the heel.

13. The shoe according to claim 12 wherein the rearward shank portion is shorter than the two forward shank portions which are of equal length.

14. The shoe according to claim 11 wherein there are four shank portions of the fastener, two opposed rearward shank portions and two opposed forward shank portions arranged to enter opposite side portions of the heel when the rearward shank portion enters opposite side portions of the rearward portion of the heel.

15. The fastener according to claim 14 wherein the two rearward shank portions are of equal length and shorter than the two forward shank portions which are of equal length.

* * * * *